US007111554B2

(12) United States Patent
Aronson

(10) Patent No.: US 7,111,554 B2
(45) **Date of Patent: *Sep. 26, 2006**

(54) LOCK ASSEMBLY FOR A STAMPING DEVICE

(75) Inventor: Marc L. Aronson, Pittsburgh, PA (US)

(73) Assignee: Commonwealth Notary Supplies, Inc., Pittsburgh, PA (US)

( * ) Notice: Subject to any disclaimer, the term of this patent is extended or adjusted under 35 U.S.C. 154(b) by 141 days.

This patent is subject to a terminal disclaimer.

(21) Appl. No.: 11/031,246

(22) Filed: Jan. 7, 2005

(65) Prior Publication Data

US 2006/0150842 A1 Jul. 13, 2006

(51) Int. Cl.
*B41K 1/56* (2006.01)

(52) U.S. Cl. ..... 101/405; 101/334; 101/333; 101/93; 70/160; 70/449

(58) Field of Classification Search ..... 101/93, 101/160, 449; 70/14, 449, 160, 232
See application file for complete search history.

(56) References Cited

U.S. PATENT DOCUMENTS 1,236,801 A * 8/1917 Willard ..... 101/35
1,296,301 A * 3/1919 McClure ..... 70/447
4,120,182 A * 10/1978 Michelman et al. ..... 70/63
4,334,578 A * 6/1982 Labrum ..... 166/75.13
4,353,521 A * 10/1982 Webb ..... 248/552
4,389,764 A * 6/1983 Flander et al. ..... 29/416
5,152,223 A * 10/1992 Mairon ..... 101/334
5,271,332 A * 12/1993 Guirguis ..... 102/476
5,727,467 A * 3/1998 Skopek ..... 101/334
5,768,992 A * 6/1998 Daw et al. ..... 101/334
5,855,129 A * 1/1999 Warren et al. ..... 70/234
6,058,840 A * 5/2000 Poplawski et al. ..... 101/405
6,067,905 A * 5/2000 Faber ..... 101/334

FOREIGN PATENT DOCUMENTS

JP 55021205 * 2/1980
JP 55021206 * 2/1980
JP 55142689 * 11/1980
JP 10297072 * 11/1998

* cited by examiner

*Primary Examiner*—Andrew H. Hirshfeld
*Assistant Examiner*—Marissa Ferguson-Samreth
(74) *Attorney, Agent, or Firm*—Clifford A. Poff

(57) ABSTRACT

A lock apparatus for securing a hand-stamping device to prevent an unauthorized stamping operation includes two locking heads constructed to establish a ridged interconnection with the base frame and the upper actuator frame of the hand-stamping device. The locking heads are releasable interconnected by parallel spaced apart struts for connecting the locking heads in a space apart relation for receiving the hand-stamping device between the struts whereby the locking heads and the struts encircle the outer periphery of the hand-stamping device. A lock is used to interlocking the locking heads in a spaced apart relation between the struts.

10 Claims, 4 Drawing Sheets

10
38
28
32
34
30
11
14
31
16
12
20

26
14
20
18
24
16
22
26
12

10
38
28
36
30
34
11
16
31
12
18
20

LOCK ASSEMBLY FOR A STAMPING DEVICE

CROSS-REFERENCE TO RELATED APPLICATIONS

Not applicable

BACKGROUND OF THE INVENTION

1. Field of the Invention

The present invention relates to a lock apparatus to control operation of a hand stamping device, and, more particularly, to such a lock apparatus embodying a construction limiting access to a stamp platen and preferably of a movement of a stamped platen to an operative position at a window opening for the platen in the hand stamping device.

2. Description of the Prior Art

U.S. Pat. Nos. 4,432,281 and 4,735,143 disclose the construction of two different stamping devices useful to apply ink impressions to a document. The platen bearing the indicia to be imprinted is normally freely assessable to anyone having access to the stamping device. Thus, a platen a bearing notaries certification or bearing a resemblance of a signature of an individual are two examples of a need to prevent unauthorized use of a stamping device even in those instances where the stamping device becomes accessible. Sometimes the only deterrent to unauthorized use is the storage of a stamping device at a location that is only out of sight to the public. However it may be insufficient to store the stamping device in a desk drawer or the like that is normally protected by a lock against unauthorized access to the contents of the drawer. The consequence of unauthorized use of the stamping device may be extreme and remain undetected or even wrongly assume to be authorized. Sometimes a ledger may be maintained to list all authorized usage, which is useful only if there were a suspected fraudulent use of a stamping device. A need therefore exists for an apparatus to prevent the use of the stamping device independently use of the environment in which the stamping device resides.

Accordingly, it is an object of the present invention to provide an apparatus to prevent unauthorized use of a hand-stamping device by preventing access to proprietary indicia provided on a platen moveable to an ink medium.

It is a further object of the present invention to provide a lock apparatus easily installed and removed from a hand-stamping device and without wear and tear to the hand-stamping device.

SUMMARY OF THE INVENTION

According to the present invention there is provided a lock apparatus in combination with a hand stamping device, the hand stamping device including an actuator frame slidable a predetermined distance relative to a base frame to present a stamp platen residing in a frame cavity to a window in the base frame, the lock apparatus including the combination of locking heads having upstanding anchor walls protruding from a back wall such that the anchor walls of one locking head receive the actuator frame and the anchor walls of the other locking head receive the base frame to prevent access to the stamp platen, struts for connecting the locking heads in a space apart relation with the anchor walls extending toward each other for receiving the actuator frame and the base frame of the hand stamping device there between, and a lock for interlocking the locking heads in a spaced apart relation between the struts.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figures 1, 2, 3:
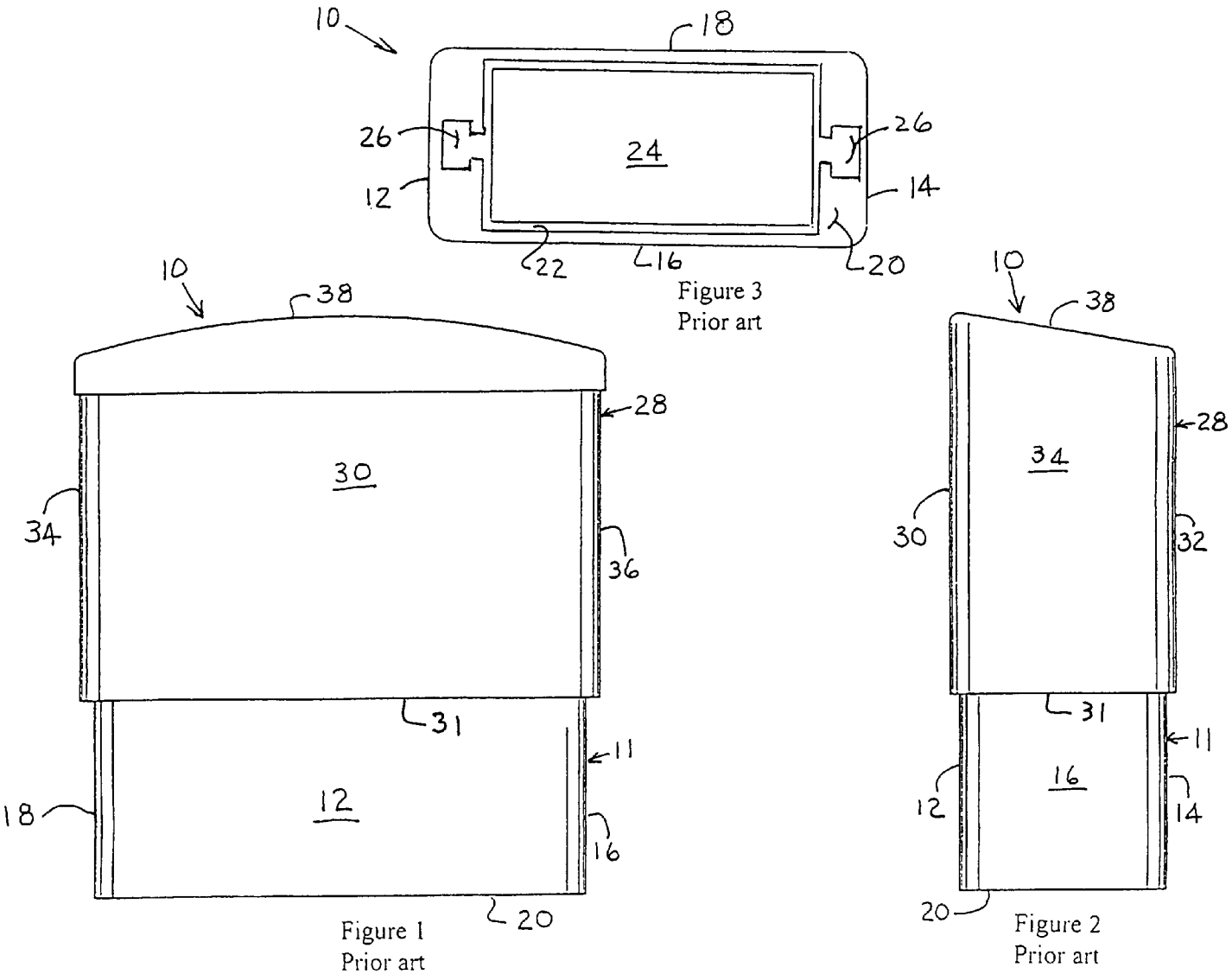
Figure 2 Prior art
Figure 3 Prior art
Figure 1 Prior art
FIG. 1 is a front elevational view of a typical hand-stamping device as well known in the art.
FIG. 2 is a side elevational view of the device shown in FIG. 1.
FIG. 3 is a bottom view of the device shown in FIG. 1.

The hand stamping device 10 as shown in FIGS. 1, 2 and 3 of the drawings is typical of stamping devices per se well known in the art and suitable for use with the locking apparatus of the present invention. The hand-stamping device 10 comprises a hollow base frame 11 with sidewalls 12 and 14 joined with end walls 16 and 18 terminating at an open rectangular lower end face 20 to bear against a supporting surface containing a document to receive a stamped impression thereon. The walls 12, 14, 16 and 18 at the end face 20 form boundaries to a window of a frame cavity 22 in which a stamp platen 24 can be displaced from an inking position in a confronting relation with an inking pad in the upper part of the frame 11 to a stamping position lying in the window at the end face 20. Cam followers moveable along cam tracks 26 operate to invert the stamp platen during the course of travel between the inking position and the stamping position. An upper actuator frame 28 is formed by sidewalls 30 and 32 joined with end walls 34 and 36 forming an internal cavity closed by a top wall 38 and terminating at a circumferential edge 31. The internal cavity of the upper actuator frame 28 fits with and is displaced along the base frame member 11 for providing the driving force to move the cam followers along the cam tracks 26 for moving and inverting the stamp platen. Springs, not shown, normally hold the actuator frame in a displaced position from which an operator can move the actuator frame 28 along the base frame member 11 to the stamping position.

Figure 5:
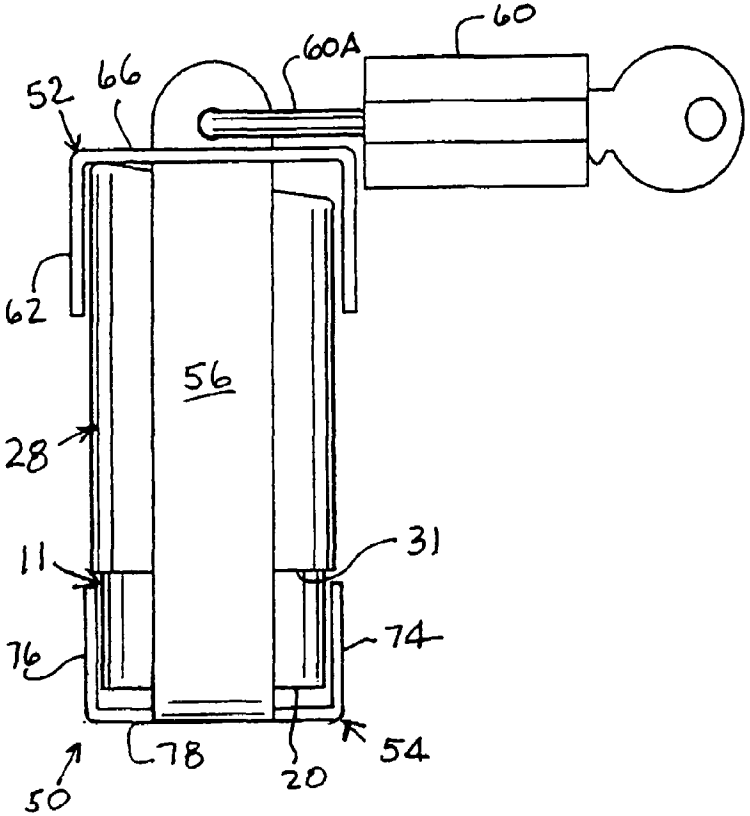
FIG. 5 is a right side elevational view taken along lines V—V of FIG. 4.
Figure 4:
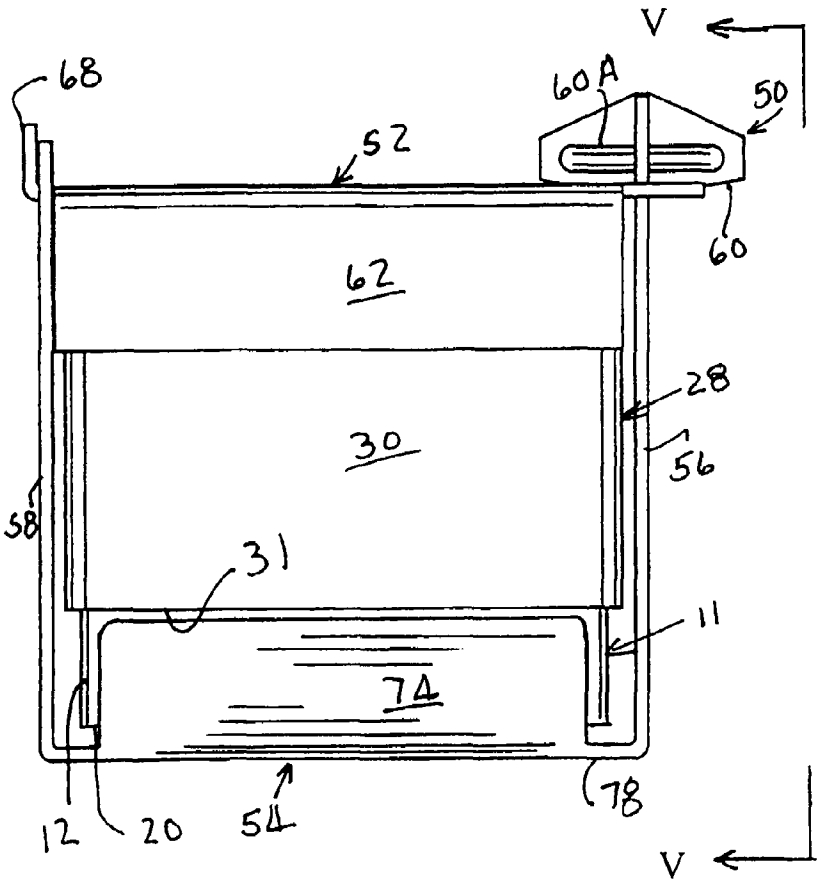
FIG. 4 is a front elevational view of the preferred embodiment of lock apparatus for the typical hand-stamping device shown in FIG. 1.

A lock apparatus 50 embodies the features according to the preferred embodiment of the present invention is shown in FIGS. 4 and 5 for securing the hand stamping device 10 that is only typical of hand stamping devices which the present invention is useful to prevent an unauthorized stamping operation. The lock apparatus includes two locking heads 52 and 54 constructed to establish a ridged interconnection with the base frame 11 and the upper actuator frame 28, respectfully. The locking heads 52 and 54 are releasable interconnected by parallel spaced apart struts 56 and 58 used to connect the locking heads in a spaced apart relation for receiving the hand-stamping device 10 between the struts whereby the locking heads and struts encircle the outer periphery of the hand-stamping device 10. A lock 60 interlocks the locking heads in a spaced apart relation between the struts. The lock 60 is shown with a cooperating key, but the present invention is useful with any per se well-known forms of a lock device.

Figure 8:
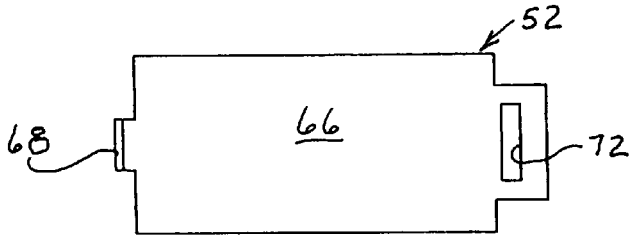
FIG. 8 is a plane view taken along lines VIII—VIII of FIG. 6.
Figure 6:
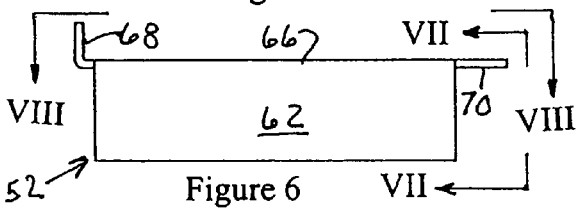
FIG. 6 is a front elevational view of one locking head forming part of the preferred embodiment of lock apparatus.
Figure 7:
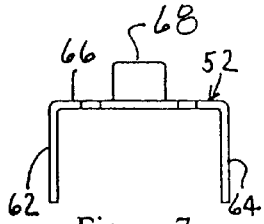
FIG. 7 is a right side elevational view taken along lines VII—VII of FIG. 6.
Figure 11:
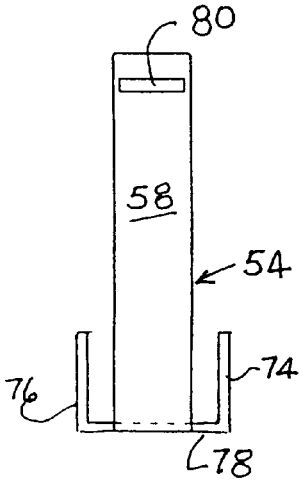
FIG. 11 is a left side elevational view taken along lines XI—XI of FIG. 9.
Figure 9:
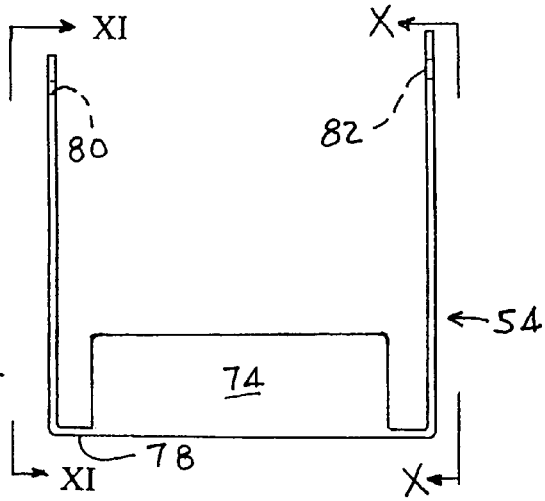
FIG. 9 is a front elevational view of a second locking head combined with struts forming part of the preferred embodiment of lock apparatus.
Figure 10:
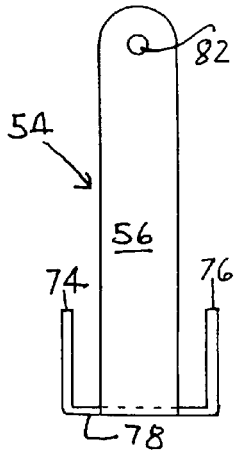
FIG. 10 is a right side elevational view taken along lines X—X of FIG. 9.

The details of the construction of the locking head 52 are shown in FIGS. 6, 7, and 8 and are particularly characterized by upstanding and generally parallel anchor walls 62 and 64 protruding from an elongated back wall 66. A leg hinge lug 68 and a tab 70 containing an aperture 72 are provided outwardly beyond the opposite ends of the elongated back wall 66. The details of the construction of the locking head 54 and the struts 56 and 58 are shown in FIGS. 9, 10, and 11. Upstanding anchor walls 74 and 76 extend in a parallel and spaced apart relation from an elongated back wall 78. In the preferred embodiment, the struts 56 and 58 are integral with the back wall 78 and are formed as perpendicular extensions extending in generally a parallel relation from the opposite ends of the back wall 78. The extended terminal end of the strut 56 is formed with a slot 80 for receiving the leg hinge lug 68 and thereby formed a hinge interconnection between the strut 58 and locking head 52. A hinged interconnection can, if desired, be accomplished by a conventional hinge utilizing a hinge pin. Other forms of releasable interconnecting tab and slot connectors carried by one of the locking heads and one of the struts can be used without departing from the present invention. The extended terminal end of the strut 58 is dimensioned to freely pass through the aperture 72 and the end portion projecting there beyond is formed with an annular aperture 82 for receiving a lock bar 60A of the lock 60. Other forms of releasable interconnecting tab and slot connectors carried by one of the locking heads and one of the struts for receiving the lock can be used. The back wall 78 of the locking head 54 is defined by a length and width substantially corresponding to length and width of the base frame 11. The anchor walls 74 and 76 are dimensioned and arranged to extend along opposite lateral sides of the base frame and into a closely spaced and confronting relation with the circumferential edges 31 of the side walls 30 to prevent advancing movement of the upper actuator frame 28 along the base frame 11 and thereby prevent useful access to the stamp platen.

Figure 13:
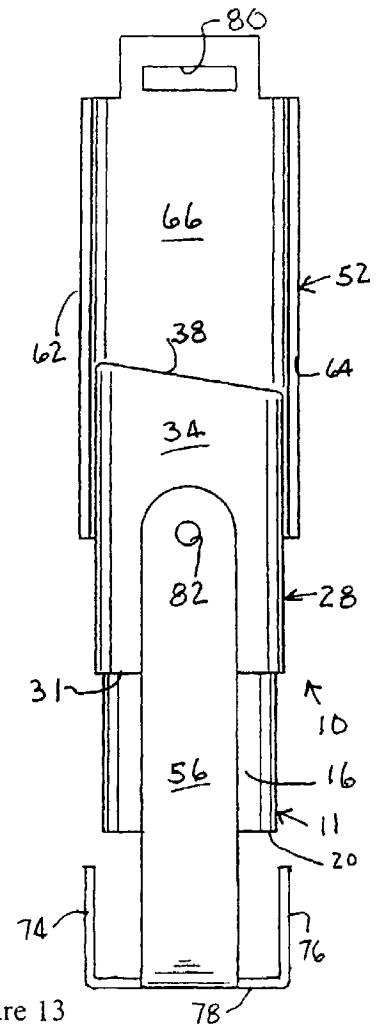
FIG. 13 is a right side elevational view taken along lines XIII—XIII of FIG. 12.
Figure 12:
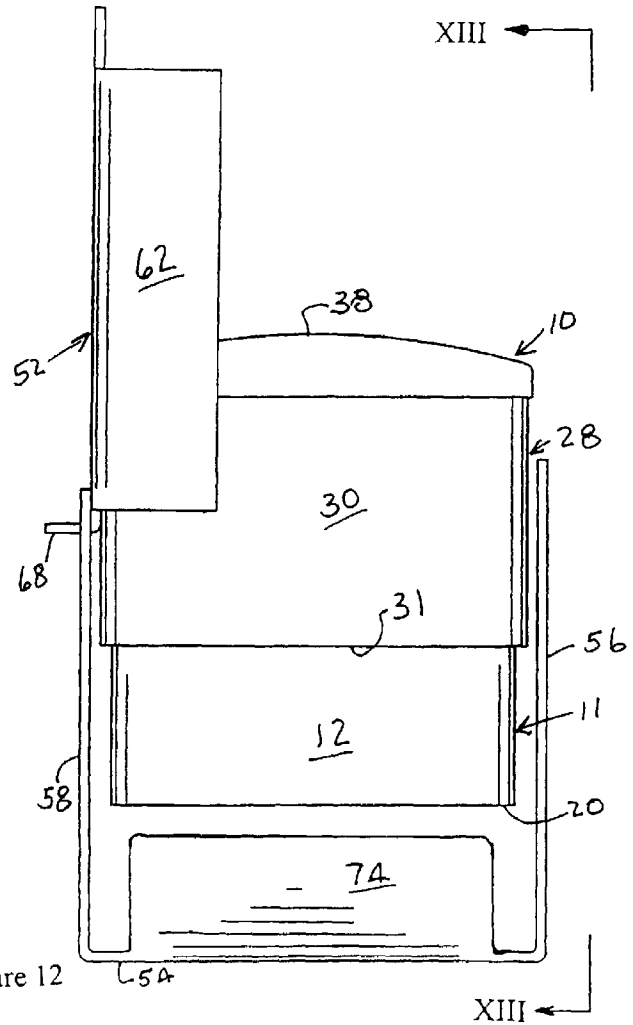
FIG. 12 is a front elevational view illustrating the assembly typical hand stamping device shown in FIG. 1 in the preferred embodiment of lock apparatus.

FIGS. 4, 5, 12, and 13 illustrate the assembling of the hand stamping device 10 in the lock apparatus of the present invention. As shown in FIGS. 12 and 13 the leg hinge lug 68 has been assembled in the slot 80 and the back wall 66 positioned to extend parallel with strut 58. The hand stamping device 10 is introduced between the parallel anchor walls 62 and 64 and advanced between the struts 56 and 58 to a seated position shown in FIGS. 4 and 5 in which the end face 20 abuts the back wall 78 of a locking head 54 and the anchor walls 74 and 76 extend along the sidewalls 12 into a closely spaced and confronting relation with the edges 31 when the hand stamp is fully seated in the locking frame to prevent advancing movement of the platen in the frame cavity 22. There after the locking head 52 is rotated about the hinged connection formed by the engagement of the lug 68 in the slot 80. The parallel anchor walls 62 and 64 pass along opposite sides of the actuator frame 28 thus entrapping the actuator frame when the aperture 82 in the end portion of strut 56 passes through the aperture 72 sufficiently allows the installation of the lock bar 60A of the lock 60 in the aperture 82.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation of the appended claims.

The invention claimed is:

1. A lock apparatus in combination with a hand stamping device, said hand stamping device including an actuator frame slidable a predetermined distance relative to a base frame to present a stamp platen residing in a frame cavity to a window in the base frame, said lock apparatus including the combination of:

locking heads having upstanding anchor walls protruding from a back wall such that the anchor walls of one locking head receive said actuator frame and the anchor walls of the other locking head receive said base frame to prevent access to said stamp platen;

struts for connecting said locking heads in a space apart relation with said anchor walls extending toward each other for receiving said actuator frame and said base frame of said hand stamping device there between; and a lock for interlocking said locking heads in a spaced apart relation between said struts.

2. The lock apparatus according to claim 1 further including releasable interconnecting tab and slot connectors carried by one of said locking heads and one of said struts.

3. The lock apparatus according to claim 1 further including releasable interconnecting tab and slot connectors carried by one of said locking heads and one of said struts for receiving said lock.

4. The lock apparatus according to claim 1 wherein said struts are integral with one of said locking heads.

5. The lock apparatus according to claim 1 wherein said anchor walls extend in a parallel spaced apart relation from one of said locking heads.

6. The lock apparatus according to claim 1 wherein said anchor walls extend in a parallel spaced apart relation from each of said locking heads.

7. The lock apparatus according to claim 6 wherein the anchor walls of said anchor walls of the other locking head have an extending length for protruding a distance corresponding to said predetermined distance the actuator frame slides relative to said base frame to prevent access to said stamp platen.

8. The lock apparatus according to claim 6 wherein said anchor walls extend in a parallel spaced apart relation from the other of said locking heads.

9. The lock apparatus according to claim 1 wherein said back wall of said other locking head is defined by a length and width substantially corresponding to a length and width of that portion of said base frame protruding from said actuator frame.

10. The lock apparatus according to claim 1 wherein said upstanding anchor walls protruding from said back wall of said other locking head have an extending length for protruding along opposite sides of said base frame and wherein said upstanding anchor walls protruding from said back wall of said one locking head have an extending length for protruding along opposite sides of said actuator frame.

* * * * *